United States Patent [19]

Tuthill et al.

[11] Patent Number: 4,815,664

[45] Date of Patent: Mar. 28, 1989

[54] AIRBLAST FUEL ATOMIZER

[75] Inventors: Richard S. Tuthill, Bolton; James M. Long, Windsor; Robert H. Larson, Old Lyme; Terry A. Clark, East Hartford, all of Conn.

[73] Assignee: United Technologies Corporation, Hartford, Conn.

[21] Appl. No.: 27,574

[22] Filed: Mar. 19, 1987

[51] Int. Cl.[4] ..... B05B 7/10

[52] U.S. Cl. ..... 239/404; 239/406; 239/424

[58] Field of Search ..... 234/400, 402–406, 234/419, 419.5, 423, 424, 428, 463, 472, 473, 487, 488

[56] References Cited

U.S. PATENT DOCUMENTS

| | | | |
|---|---|---|---|
| 738,131 | 9/1903 | Weaver | 239/488 X |
| 1,885,067 | 10/1932 | Woodeson | 239/403 |
| 3,175,817 | 3/1965 | Smith et al. | 239/403 |
| 3,713,588 | 1/1973 | Sharpe | 239/400 |
| 3,834,159 | 9/1974 | Vloviak | 239/403 X |
| 3,915,387 | 10/1975 | Caruel et al. | 239/404 X |
| 4,600,377 | 7/1986 | Musil | 239/405 X |
| 4,609,150 | 9/1986 | Pane | 239/404 X |

FOREIGN PATENT DOCUMENTS

| | | | |
|---|---|---|---|
| 1152163 | 3/1988 | United Kingdom | 239/487 |

*Primary Examiner*—Andres Kashnikow
*Assistant Examiner*—Kevin P. Weldon
*Attorney, Agent, or Firm*—Edward L. Kochey, Jr.

[57] ABSTRACT

An airblast fuel nozzel (16) for a gas turbine includes a central swirled airflow. The vanes (52) of the swirler (30) are cambered to provide smooth intercept and discharge of air, thereby effecting more uniform fuel distribution than the prior art.

5 Claims, 2 Drawing Sheets

AIRBLAST FUEL ATOMIZER

BACKGROUND OF THE INVENTION

The invention relates to nozzles for spraying fuel into gas turbine combustion chambers and in particular to an improvement of the airblast-type nozzle.

Combustion chambers of gas turbines conventionally include a metal shell or liner which defines a volume in which combustion takes place. Space is limited and it therefore is important that combustion take place as quickly and uniformly as possible. This requires not only fine atomization of the fuel being injected but a uniform distribution thereof.

A conventional fuel pressure atomizing nozzle distributes and atomizes the fuel adequately at part power ratings. As load is increased on the turbine, however, the increased fuel flow leads to very high pressure drop across the nozzle and very fine droplets producing poor penetration and distribution of the fuel in the combustor.

Accordingly, airblast type spray nozzles have been introduced. Such nozzles generally use the airflow for the source of atomizing and distribution energy since the airflow patterns tend to stay relatively constant as load is increased.

Conventionally such nozzles would include a central primary flow of air inside an annular zone in which fuel is introduced. Surrounding the fuel is an annular introduction of secondary air, with tertiary air occasionally directed from a location slightly more remote from the fuel. Additional dilution air is introduced downstream of the combustion process to limit the temperature entering the gas turbine to an acceptable limit.

U.S. Pat. No. 3,713,588 illustrates such a nozzle wherein the fuel is introduced outwardly through a series of orifices into the secondary air stream. This swirling secondary air stream provides the atomizing force and energy to disperse the fuel. In accordance with the teachings of that patent the primary centrally located air is introduced for the purpose of providing an ample supply of air to the interior of the fuel spray cone. A set of helical swirler vanes are illustrated and it is stated that the interior air may be introduced without any swirl at all.

Specific relative locations are shown between the vanes swirling the secondary air and the orifices for the entrance of fuel. The objective in the teaching of that patent is to obtain concentrations of air at the location of the orifices.

Another airblast injector is known wherein the fuel is swirled for the purpose of filling an annular space from which it passes out at a relatively low velocity. The swirl of primary air is used to disperse and atomize the fuel as it exits the fuel nozzle. The swirl of airflow has been obtained by the use of helical vanes.

Helical vanes are simpler and less expensive to form than cambered vanes. Cambered vanes, however, have been used on secondary airflow where the major portion of combustion supporting air is supplied and there is a need to pass a substantial amount of air through a limited space. In such case the lower pressure drop characteristic of the cambered vanes was sufficient to justify the additional expense of their manufacture. The primary air vane swirler is very small with an outside diameter on the order of one-half inch. The need has not been to supply a large quantity of air through a small space but only to obtain a swirl. Accordingly, conventional wisdom has not suggested anything other than the more easily manufactured, less expensive helical swirler which has always been used at this location.

SUMMARY OF THE INVENTION

We have discovered that the circumferential fuel distribution of a nozzle using helical vanes suffered maldistribution which contained concentrations of fuel in a repeating pattern which related to the number of helical vanes installed. We have further found that using cambered vanes which intercept the airflow smoothly with a gradual curve to provide the swirl will avoid the local flow disturbances which appear to carry through to the distribution of fuel.

Our airblast nozzle has a low velocity swirled fuel flow discharged through an annular space in a surrounding secondary airflow. The swirled inner primary flow stream located concentrically within the fuel has cambered vanes located upstream of the discharge for the purpose of establishing a swirl. These fixed vanes are located in the airflow with the upstream edge substantially parallel to the incoming airflow and with the vanes cambered to extend at an angle with the incoming airflow at the downstream end. This swirl of primary air so established without flow disturbances has been found to provide uniform circumferential distribution of the atomized fuel.

Increasing the size of the hub beyond that previously used facilitates the fabrication of the more difficult to form cambered vanes, may provide an improved recirculation zone downstream of the air supply and does not restrict the airflow compared to the helical vanes because of the more efficient flow characteristics.

DESCRIPTION OF THE PREFERRED EMBODIMENT

Figure 1:
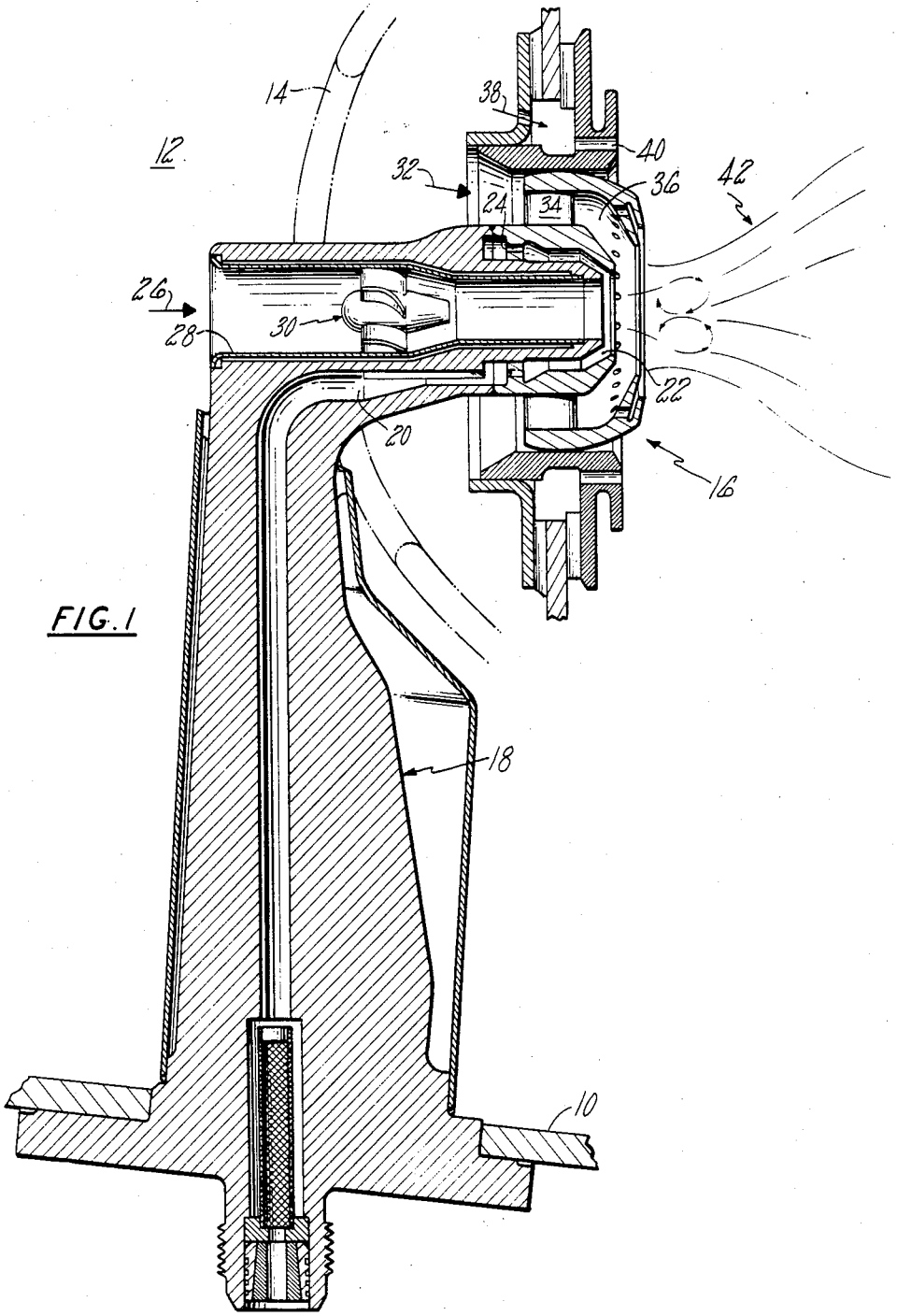
FIG. 1 is a general arrangement of the fuel nozzle.
Figure 2:
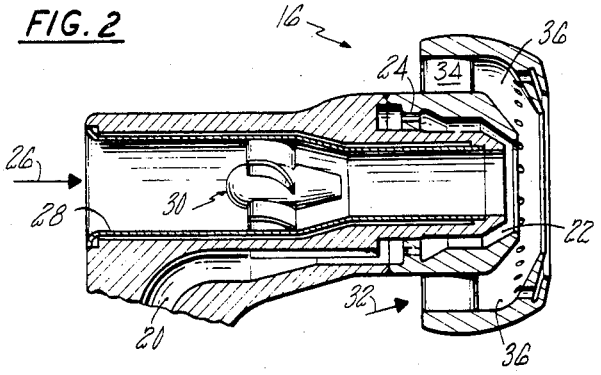
FIG. 2 is an expanded detail in the nozzle area.

Illustrated in the general arrangement of FIG. 1 is casing 10 which surrounds an air plenum 12 confining the airflow. Within this casing is combustion chamber liner 14 with fuel nozzle 16 mounted on strut 18 so as to be located within the combustion chamber liner. Fuel passes through supply passage 20 discharging through an annular space 22. Swirling structure 24 is an integral annular metal piece with a plurality of holes drilled at an angle with respect to the axis. This provides a nominal swirl of the fuel so as to distribute it uniformly around the circumference of the annular space 22. The primary airflow 26 is delivered through primary air tube 28 to a location concentrically within the annular space 22. A fixed vane assembly 30 is located within this airstream to provide a swirl to the primary air passing through.

Additional secondary air 32 passes through swirler vanes 34 being directed inwardly through annular space 36 toward the discharged fuel. Further, tertiary air 38 passes through opening 40 as guide air selected to additionally shape the flame. Additional air from air plenum 12 joins the combustion products at a downstream location (not shown).

Figure 3:
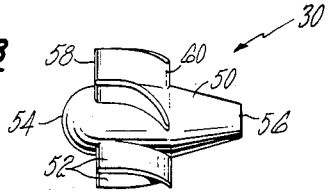
FIG. 3 is an oversized view of the vane assembly.

The above-described nozzle produces a generally conically-shaped flame 42 which burns the fuel within the combustion chamber. Because of the limited space available it is important that the fuel be consumed as quickly as possible and uniform atomization and distribution of the fuel facilitates this by avoiding any long burning local deviations. It is also important to have the uniform circumferential distribution to avoid local hot spots or streaks which would locally burn out the turbine vanes of combustion liner. Such objectives are obtained by the use of the specific swirler 30 which is illustrated in detail in FIG. 3.

A central hub 50 carries a plurality of cambered vanes 52 on its circumference. The vane assembly has an outside diameter to the edge of the vanes 52 of 0.5 inches while the diameter of hub 50 is 0.25 inches. The upsteam end 54 is formed of a uniform radius forming a bulletnose shape while the downstream edge 56 may be a truncated conical surface.

Figure 4:
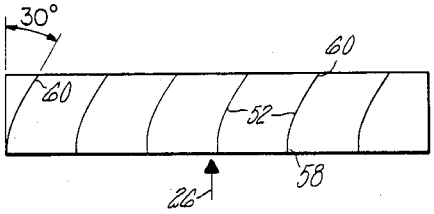
FIG. 4 is a developed view around the periphery of the vane assembly.
Figure 5:
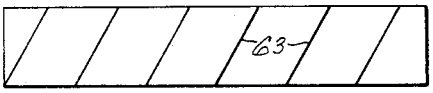
FIG. 5 PRIOR ART
FIG. 5 is a developed view of the prior art.

FIG. 4 is a developed view of the outside cylinder surrounding the outer edge of vanes 52. Helical vanes when illustrated in a two dimensional view often appear to be curved but their true shape as shown in a developed view shows that they are straight much in the manner of screw threads. The developed view actually shows the vanes as they look to the airflow passing therethrough. Accordingly, it can be seen in FIG. 4 that the upstream edge 58 of each vane is substantially parallel to the incoming airflow 26 while the uniform curve of the cambered vanes 52 results in the discharge end 60 being at an angle of 30 degrees with the axis of the vane assembly and the direction of the incoming airflow. By way of comparison, FIG. 5 shows a developed view of a swirler with conventional helical vanes 63. Test operation and observation has shown that this superficially minor change of the substitute of curved or cambered vanes for helical vanes results in a surprising improvement and performance of the fuel nozzle.

We claim:

1. In an airblast liquid fuel nozzle for a gas turbine, of the type having, a low velocity swirled fuel flow discharged through an annular space, a surrounding secondary airflow directed toward the discharged fuel, a swirled inner primary airflow stream located concentrically within the annular space and directed to disperse and atomize the discharged fuel, and fixed vanes located in the primary airflow to establish the swirl, the improvement comprising:

said vanes having the upstream edge substantially parallel to the incoming airflow; and said vanes cambered to extend at an angle with the incoming airflow at the downstream end, whereby the swirled flow is established without the formation of local flow disturbances.

2. An apparatus as in claim 1:

said vanes located on a vane assembly having an axis parallel to the primary airflow;

the inlet edge of said vanes forming an angle with respect to said axis of less than 10 degrees; and the discharge end of said vanes forming an angle with respect to said axis of between 25 and 70 degrees.

3. An apparatus as in claim 1:

the curve of said cambered vanes having a constant radius.

4. An apparatus as in claim 1:

said vanes located on a vane assembly having an axis parallel to the primary airflow;

a central axially extending core carrying said vanes;

the upstream edge of said core having a radius forming a bulletnose shape.

5. An apparatus as in claim 4:

the outside diameter of said core being greater than 40 percent of the outside diameter of said vane assembly.

* * * * *